US011603868B2

(12) United States Patent
Tabata

(10) Patent No.: US 11,603,868 B2
(45) Date of Patent: Mar. 14, 2023

(54) PRESSURIZING DEVICE

(71) Applicant: SUMITOMO HEAVY INDUSTRIES, LTD., Tokyo (JP)

(72) Inventor: Satoshi Tabata, Ehime (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/577,838

(22) Filed: Jan. 18, 2022

(65) Prior Publication Data

US 2022/0228607 A1 Jul. 21, 2022

(30) Foreign Application Priority Data

Jan. 18, 2021 (JP) ..... JP2021-005848

(51) Int. Cl.
*F15B 11/16* (2006.01)
*F15B 15/14* (2006.01)
*F15B 11/17* (2006.01)

(52) U.S. Cl.
CPC ..... *F15B 11/165* (2013.01); *F15B 11/17* (2013.01); *F15B 15/14* (2013.01); *F15B 2015/1495* (2013.01); *F15B 2211/20576* (2013.01); *F15B 2211/5155* (2013.01); *F15B 2211/6313* (2013.01); *F15B 2211/6653* (2013.01)

(58) Field of Classification Search
CPC ..... F15B 7/001; F15B 7/08; F15B 11/028; F15B 11/032; F15B 11/0325; F15B 11/13; F15B 11/165; B30B 15/161; B30B 15/22; F04B 9/04; F04B 9/047; F04B 13/00
See application file for complete search history.

(56) References Cited

U.S. PATENT DOCUMENTS 6,973,780 B2 * 12/2005 Hahn ..... B30B 15/163 60/413
10,480,547 B2 * 11/2019 Starkey ..... F04B 17/03

FOREIGN PATENT DOCUMENTS

IT UB20160549 A1 * 8/2017 ..... F15B 11/0325
JP 2012-237419 A 12/2012

* cited by examiner

*Primary Examiner* — Michael Leslie
(74) *Attorney, Agent, or Firm* — Michael Best & Friedrich LLP

(57) ABSTRACT

A pressurizing device includes: a pressurizing unit that pressurizes a pressurized object by supplying a working fluid; a first cylinder mechanism that supplies the working fluid in a first cylinder to the pressurizing unit by output of a first drive source; a second cylinder mechanism that supplies the working fluid in a second cylinder to the pressurizing unit by output of a second drive source; and a control device that controls the first drive source and the second drive source, in which the control device performs transition control to transition to a second supply state of supplying the working fluid from the second cylinder mechanism to the pressurizing unit when satisfying a remaining amount condition of the working fluid in the first cylinder of the first cylinder mechanism in a first supply state of supplying the working fluid from the first cylinder mechanism to the pressurizing unit.

11 Claims, 3 Drawing Sheets

FIG. 4

| NO. | HYDRAULIC CONTROL OPERATION | | HYDRAULIC JACK PT011 [MPa] | NO.1 PUMP PLUNGER POSITION [-] | NO.1 PUMP PUMP OPERATION [-] | NO.1 PUMP PRESSURE [MPa] | NO.1 PUMP JACK-SIDE VALVE [-] | NO.1 PUMP TANK-SIDE VALVE [-] | NO. 2 PUMP PLUNGER POSITION [-] | NO. 2 PUMP PUMP OPERATION [-] | NO. 2 PUMP PRESSURE [MPa] | NO. 2 PUMP JACK-SIDE VALVE [-] | NO. 2 PUMP TANK-SIDE VALVE [-] | OPERATION OF WAITING PUMP | |
|---|---|---|---|---|---|---|---|---|---|---|---|---|---|---|---|
| 1 | NO.1 PUMP | PRESSURE RISING START | A | EFFECTIVE RANGE OF MOTION | ON | A | ON | OFF | BEFORE SUCTION END | OFF | - | OFF | OFF | NO.2 PUMP | WAITING |
| 2 | ↑ | DURING PRESSURE RISING | B | BEFORE DISCHARGE END | ON | B | ON | OFF | ↑ | ON | TOWARD B | OFF | OFF | ↑ | OPERATION IN ACCORDANCE WITH PRESSURE B |
| 3 | NOS.1 & 2 PUMPS | DURING PRESSURE RISING | C | DISCHARGE RESIDUAL RANGE | ON | C | ON | OFF | EFFECTIVE RANGE OF MOTION | ON | C | ON | OFF | - | BOTH NOS. 1 AND 2 PUMPS, PRESSURE RISING (TWO-PUMP OPERATION DURING TIMER) |
| 4 | NO. 2 PUMP | DURING PRESSURE RISING | D | BEFORE SUCTION END | OFF | D | OFF | ON | ↑ | ON | D | ON | OFF | NO.1 PUMP | REPLENISHMENT OF OIL FROM TANK (SUCTION) (AFTER REPLENISHMENT END. TANK-SIDE VALVE OFF) |
| 5 | ↑ | DURING HOLDING | E | ↑ | OFF | - | OFF | OFF | ↑ | ON | E | ON | OFF | ↑ | NO. 1 PUMP WAITING |
| 6 | ↑ | DURING DEPRESSURIZATION | F | ↑ | OFF | - | OFF | OFF | ↑ | ON | F | ON | OFF | ↑ | ↑ |
| 7 | ↑ | DURING DEPRESSURIZATION | G | ↑ | ON | TOWARD G | OFF | OFF | BEFORE SUCTION END | ON | G | ON | OFF | NO.1 PUMP | OPERATION IN ACCORDANCE WITH PRESSURE G |
| 8 | NOS. 2 & 1 PUMPS | DURING DEPRESSURIZATION | H | BEFORE DISCHARGE END | ON | H | ON | OFF | SUCTION RESIDUAL RANGE | ON | H | ON | OFF | - | BOTH NOS. 1 AND 2 PUMPS, DEPRESSURIZATION (TWO-PUMP OPERATION DURING TIMER) |
| 9 | NO.1 PUMP | DURING DEPRESSURIZATION | I | EFFECTIVE RANGE OF MOTION | ON | I | ON | OFF | BEFORE DISCHARGE END | OFF | - | OFF | ON | NO.2 PUMP | DISCHARGE OF OIL TO TANK (AFTER DISCHARGE END. TANK-SIDE VALVE OFF) |
| 10 | ↑ | DEPRESSURIZATION END | A | ↑ | OFF | A | ON | OFF | ↑ | OFF | - | OFF | OFF | ↑ | WAITING |

PRESSURIZING DEVICE

RELATED APPLICATIONS

The content of Japanese Patent Application No. 2021-005848, on the basis of which priority benefits are claimed in an accompanying application data sheet, is in its entirety incorporated herein by reference.

BACKGROUND

Technical Field

Certain embodiments of the present invention relate to a pressurizing device.

Description of Related Art

In a pressurizing device for increasing pressure over time until high pressure is obtained with respect to a pressurizing unit, in the past, with respect to a plunger of a plunger pump having a small-diameter cylinder, the supply of a working fluid to the pressurizing unit has been performed by performing a stroke operation of the plunger at a low speed by using a servomotor and a ball screw mechanism (refer to, for example, the related art).

SUMMARY

According to an embodiment of the present invention, there is provided a pressurizing device including: a pressurizing unit that pressurizes an object to be pressurized by supply of a working fluid; a first cylinder mechanism that includes a first drive source and a first cylinder and supplies the working fluid in the first cylinder to the pressurizing unit by output of the first drive source; a second cylinder mechanism that includes a second drive source and a second cylinder and supplies the working fluid in the second cylinder to the pressurizing unit by output of the second drive source; and a control device that controls the first drive source of the first cylinder mechanism and the second drive source of the second cylinder mechanism, in which the control device is configured to perform transition control to transition to a second supply state where the working fluid is supplied from the second cylinder mechanism to the pressurizing unit when a remaining amount condition of the working fluid in the first cylinder of the first cylinder mechanism is satisfied in a first supply state where the working fluid is supplied from the first cylinder mechanism to the pressurizing unit.

BRIEF DESCRIPTION OF THE DRAWINGS

FIG. 4 is a diagram showing control operations of the first and second cylinder mechanisms by a control device associated with a change in the internal pressure of the lower region shown in FIG. 3.

DETAILED DESCRIPTION

If the supply pressure of the working fluid that is required for a pressurizing unit becomes higher, since the inner diameter of the cylinder of the plunger pump is made smaller, the amount of the working fluid that can be supplied from the plunger pump by one stroke operation tends to decrease.

Therefore, in a case where the amount of the working fluid that can increase the pressure to a target pressure of the pressurizing unit cannot be supplied with one stroke operation, the supply of the working fluid is temporarily interrupted and the cylinder of the plunger pump is replenished with the working fluid.

There is a case where a fluctuation in the supply pressure of the working fluid occurs due to such interruption for replenishment of the working fluid, and thus there is a concern that the working fluid may not be stably supplied.

It is desirable to stably supply a working fluid to the pressurizing unit.

According to the present invention, it becomes possible to stably supply the working fluid to the pressurizing unit.

Hereinafter, an embodiment of the present invention will be described in detail with reference to the drawings.

Schematic Configuration of Pressurizing Device

Figure 1:
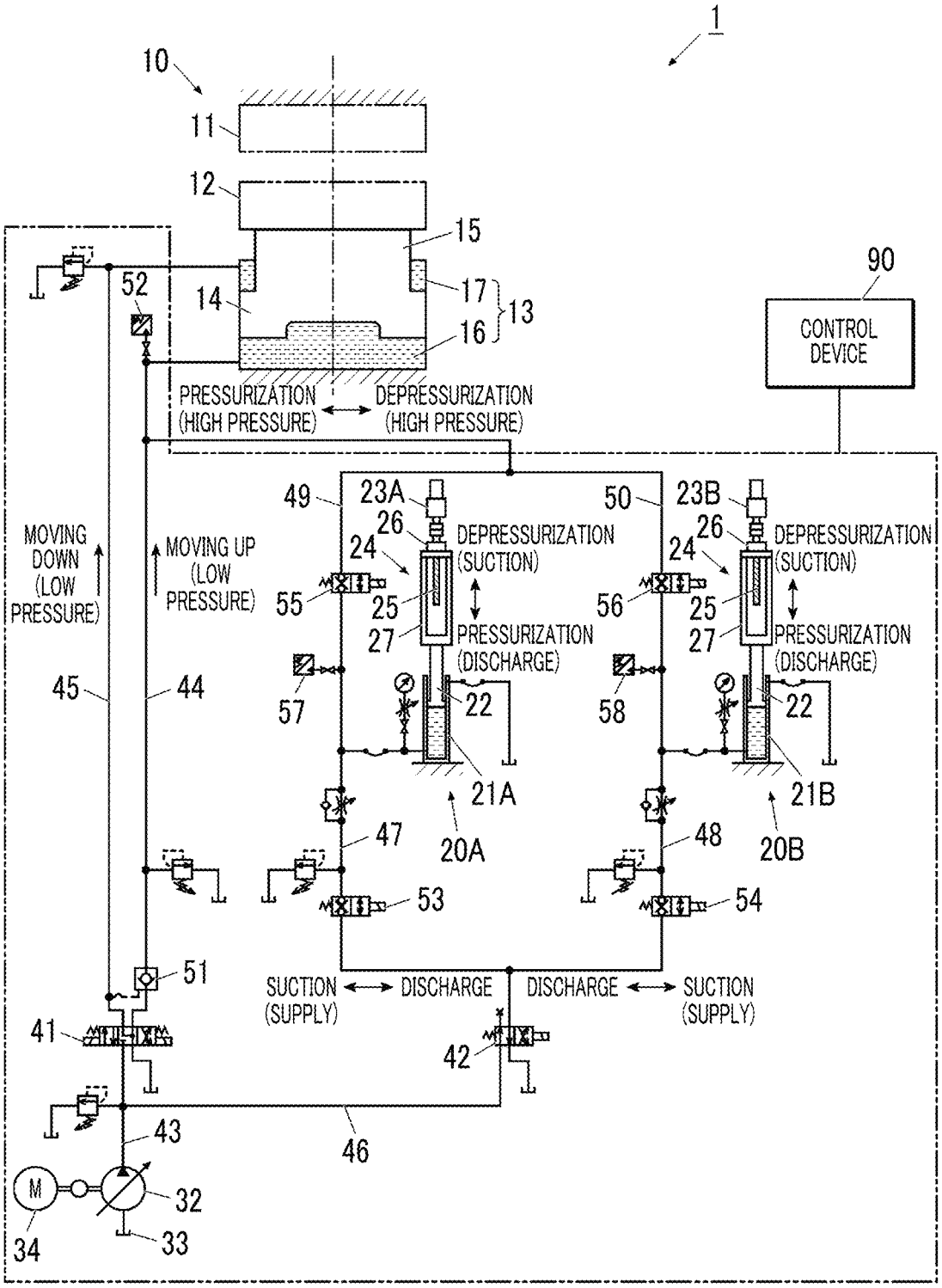
FIG. 1 is a diagram showing an overall configuration of a pressurizing device according to the present embodiment.

FIG. 1 is a diagram showing the overall configuration of a pressurizing device 1 according to the present embodiment.

As shown in the drawing, the pressurizing device 1 includes a hydraulic jack 10 as a pressurizing unit that pressurizes an object to be pressurized by supply of a hydraulic oil as a working fluid, a first cylinder mechanism 20A and a second cylinder mechanism 20B that supply the hydraulic oil to the hydraulic jack 10, a hydraulic pump 32 connected to a hydraulic oil tank 33 for supplying the hydraulic oil to the hydraulic jack 10, the first cylinder mechanism 20A, and the second cylinder mechanism 20B, a hydraulic circuit connecting the above configurations, and a control device 90 that controls the overall configuration of the pressurizing device 1.

Hydraulic Jack

The hydraulic jack 10 includes a fixed pressurizing stand 11 and a movable pressurizing stand 12, which face each other and perform pressurization between them, a cylinder 13 where supply and discharge of the hydraulic oil is performed inside, a piston 14 that slides along a pressurizing direction of the movable pressurizing stand 12 inside the cylinder 13, and a piston rod 15 that extends from the piston 14 to the outside of the cylinder 13 and is connected to the movable pressurizing stand 12.

The hydraulic jack 10 is a double-acting type, and the hydraulic oil is supplied to and discharged from a lower region (a first region) 16 and an upper region (a second region) 17 provided inside the cylinder 13 with the piston 14 interposed therebetween. Then, when the hydraulic oil is supplied to the lower region 16 of the cylinder 13, the movable pressurizing stand 12 moves toward the fixed pressurizing stand 11 through the piston 14, so that pressurization is performed between the fixed pressurizing stand 11 and the movable pressurizing stand 12. Further, when the hydraulic oil is supplied to the upper region 17 of the cylinder 13, the movable pressurizing stand 12 is separated from the fixed pressurizing stand 11 through the piston 14, so that the pressurized state is released.

The hydraulic jack 10 presses, for example, a plurality of anvils to perform ultrahigh pressure pressurization of the object to be pressurized.

Eight substantially cubic inner anvils and a pair of outer anvils for assembling and holding the eight inner anvils in a cubic shape are used, and the pair of outer anvils is disposed between the fixed pressurizing stand 11 and the movable pressurizing stand 12 to pressurize the inner anvils.

The inner anvil has corners chamfered flat, and when the eight inner anvils are assembled in a cubic shape, the object to be pressurized is disposed so as to be surrounded from all sides by the flat portions of the corners of the inner anvils, which are located at the inner center. In this way, when the hydraulic jack 10 pressurizes the pair of outer anvils at high pressure, pressure is concentrated on the flat portions of the corners of the eight inner anvils, so that the ultrahigh pressure pressurization is performed on the object to be pressurized surrounded by the flat portions.

When performing the ultrahigh pressure pressurization as described above, it is required to increase pressure of the hydraulic jack 10 accurately and stably over time.

The ultrahigh pressure pressurization of the object to be pressurized using the anvils is only an example of the use of the hydraulic jack 10, and the use is not limited to this. It goes without saying that the hydraulic jack 10 may be used for other uses of performing other stable pressurization.

Hydraulic Cylinder Mechanism

The first cylinder mechanism 20A configures a plunger pump. The configuration of the same structure of the first cylinder mechanism 20A and the second cylinder mechanism 20B will be described with the same reference numerals in principle.

The first cylinder mechanism 20A includes a hollow cylindrical first cylinder 21A, a plunger (a piston) 22 slidable inside the first cylinder 21A, a ball screw mechanism 24 as a linear motion mechanism for imparting an advance/retreat movement operation to the plunger 22, and a reduction gear-equipped servomotor 23A, which serves as a first drive source of the ball screw mechanism 24.

The second cylinder mechanism 20B includes a hollow cylindrical second cylinder 21B, a plunger (a piston) 22 slidable inside the second cylinder 21B, a ball screw mechanism 24 as a linear motion mechanism for imparting an advance/retreat movement operation to the plunger 22, and a reduction gear-equipped servomotor 23B, which serves as a second drive source of the ball screw mechanism 24.

Both the first cylinder mechanism 20A and the second cylinder mechanism 20B are single-acting cylinder mechanisms, and the hydraulic oil is supplied to and discharged from a region sealed by the plunger 22 in each of the first and second cylinders 21A and 21B.

The ball screw mechanism 24 includes a ball screw 25 that is rotationally driven by each of the reduction gear-equipped servomotors 23A and 23B, and a movable frame 27 provided with a ball nut 26 screwed to the ball screw 25.

The ball screw 25 is provided parallel to the stroke direction of the plunger 22, and the movable frame 27 is fixedly connected to an outer end portion of the plunger 22.

Each of the reduction gear-equipped servomotors 23A and 23B is provided with an encoder (not shown), which inputs the rotation amount (rotation angle) of each of the reduction gear-equipped servomotors 23A and 23B to the control device 90. Therefore, the control device 90 can control a minute rotation amount (rotation angle) of each of the reduction gear-equipped servomotors 23A and 23B.

In this way, the control device 90 controls a minute operating amount in the stroke direction of the plunger 22 through the ball screw mechanism 24 from each of the reduction gear-equipped servomotors 23A and 23B to be able to perform precise and highly accurate control of the supply/discharge amount of the hydraulic oil in each of the first and second cylinders 21A and 21B. Further, in this way, the supply amount of the hydraulic oil that is supplied to the hydraulic jack 10 is precisely controlled, and therefore, the pressurizing force of the hydraulic jack 10 can be controlled precisely and with high accuracy, so that, for example, precise pressure rising, pressurization maintenance, and depressurization over a long period of time can be performed.

The ball screw mechanism 24 may impart an advance/retreat movement operation to the side of the first and second cylinders 21A and 21B, instead of the plunger 22.

Further, the plunger of each of the cylinder mechanisms 20A and 20B is one aspect of a piston, and a piston that is not a plunger type may be used.

Further, the linear motion mechanism is not limited to the ball screw mechanism, and other linear drive means, for example, a linear motor or the like may be used.

Hydraulic Pump

The hydraulic pump 32 is connected to the hydraulic oil tank 33 in which the hydraulic oil is stored, and can supply the hydraulic oil in the hydraulic oil tank 33 to the hydraulic jack 10, the first cylinder mechanism 20A, and the second cylinder mechanism 20B at a predetermined supply pressure by using a motor 34 as a drive source.

Hydraulic Circuit

The hydraulic circuit has a first supply valve 41 for switching a connection state from the hydraulic pump 32 to the hydraulic jack 10, a second supply valve 42 for switching a connection state from the hydraulic pump 32 to the first cylinder mechanism 20A and the second cylinder mechanism 20B, a first supply/discharge pipe 43 that connects the hydraulic pump 32 and the first supply valve 41 to allow the hydraulic oil to flow between them, a second supply/discharge pipe 44 that connects the first supply valve 41 and the lower region 16 of the hydraulic jack 10 to allow the hydraulic oil to flow between them, and a third supply/discharge pipe 45 that connects the first supply valve 41 and the upper region 17 of the hydraulic jack 10 to allow the hydraulic oil to flow between them.

Further, the hydraulic circuit has a fourth supply/discharge pipe 46 that branches from the first supply/discharge pipe 43 and connects the hydraulic pump 32 and the second supply valve 42 to allow the hydraulic oil to flow between them, a fifth supply/discharge pipe 47 that connects the second supply valve 42 and the first cylinder mechanism 20A to allow the hydraulic oil to flow between them, a sixth supply/discharge pipe 48 that connects the second supply valve 42 and the second cylinder mechanism 20B to allow the hydraulic oil to flow between them, a seventh supply/discharge pipe 49 that connects the first cylinder mechanism 20A and the lower region 16 of the hydraulic jack 10 to allow the hydraulic oil to flow between them, and an eighth supply/discharge pipe 50 that connects the second cylinder mechanism 20B and the lower region 16 of the hydraulic jack 10 to allow the hydraulic oil to flow between them.

The fifth supply/discharge pipe 47 and the sixth supply/discharge pipe 48 are merged on the second supply valve 42 side, and the seventh supply/discharge pipe 49 and the eighth supply/discharge pipe 50 are merged on the hydraulic jack 10 side.

The first supply valve 41 can selectively connect the lower region 16 and the upper region 17 of the hydraulic jack 10 to the hydraulic pump 32 side and the hydraulic oil tank 33 side.

That is, the first supply valve 41 can switch between the position where the lower region 16 of the hydraulic jack 10 is connected to the hydraulic pump 32 and the upper region 17 is connected to the hydraulic oil tank 33 side, the position where the lower region 16 of the hydraulic jack 10 is connected to the hydraulic oil tank 33 and the upper region 17 is connected to the hydraulic pump 32 side, and the position where both the lower region 16 and the upper region 17 of the cylinder 13 of the hydraulic jack 10 are connected to the hydraulic oil tank 33.

The second supply valve 42 can selectively connect the first cylinder mechanism 20A and the second cylinder mechanism 20B to the hydraulic pump 32 side and the hydraulic oil tank 33 side.

That is, the second supply valve 42 can switch between the position where the merging end portions of the fifth supply/discharge pipe 47 connected to the first cylinder mechanism 20A and the sixth supply/discharge pipe 48 connected to the second cylinder mechanism 20B are connected to the hydraulic oil tank 33 side, and the position where the merging end portions are connected to the hydraulic pump 32 side.

Each of the supply/discharge pipes 43 to 45, 47, and 48 is provided with a relief valve.

Further, a pilot check valve 51 is provided at the end portion on the first supply valve 41 side of the second supply/discharge pipe 44, and a pressure sensor 52 is provided at the end portion on the lower region 16 side of the second supply/discharge pipe 44.

When the hydraulic oil is supplied from the hydraulic pump 32 to the lower region 16 of the hydraulic jack 10, the pilot check valve 51 does not obstruct the flow and restricts the backflow of the hydraulic oil from the lower region 16 of the hydraulic jack 10. However, since the pilot check valve 51 is made so as to be opened by receiving the internal pressure of the third supply/discharge pipe 45, the pilot check valve 51 is configured so as not to obstruct the flow of the hydraulic oil that is pushed back from the lower region 16 to the hydraulic oil tank 33, in a case where the hydraulic oil is supplied to the upper region 17 of the hydraulic jack 10.

The pressure sensor 52 detects the internal pressure of the lower region 16 of the hydraulic jack 10 and outputs it to the control device 90.

Tank-side valves 53 and 54, which are shut-off valves, are respectively provided in the fifth and sixth supply/discharge pipes 47 and 48. Further, jack-side valves 55 and 56, which are shut-off valves, are respectively provided in the seventh and eighth supply/discharge pipes 49 and 50. The jack-side valve 55 functions as a first switching unit configured to switch between a connection state and a disconnection state of the flow of the hydraulic oil between the first cylinder mechanism 20A and the lower region 16 of the hydraulic jack 10, and the jack-side valve 56 functions as a second switching unit configured to switch between a connection state and a disconnection state of the flow of the hydraulic oil between the second cylinder mechanism 20B and the lower region 16 of the hydraulic jack 10.

The valves 53 to 56 are individually opened by the command of the control device 90, so that the flow of the hydraulic oil becomes possible.

Further, in the seventh and eighth supply/discharge pipes 49 and 50, pressure sensors 57 and 58 are provided near the side of the first and second cylinders 21A and 21B with respect to the jack-side valves 55 and 56 respectively provided in the seventh and eighth supply/discharge pipes 49 and 50. The pressure sensors 57 and 58 individually detect the internal pressure of the first cylinder 21A of the first cylinder mechanism 20A and the internal pressure of the second cylinder 21B of the second cylinder mechanism 20B, and output them to the control device 90.

That is, the pressure sensor 57 functions as a first pressure measuring unit that measures the pressure of the hydraulic oil of the first cylinder mechanism 20A, and the pressure sensor 58 functions as a second pressure measuring unit that measures the pressure of the hydraulic oil of the second cylinder mechanism 20B.

Control Device

The control device 90 is connected to the reduction gear-equipped servomotors 23A and 23B of the first and second cylinder mechanisms 20A and 20B, the motor 34 of the hydraulic oil tank 33, the first supply valve 41, the second supply valve 42, the tank-side valves 53 and 54, and the jack-side valves 55 and 56, and controls their operations.

Further, the control device 90 is connected to the pressure sensors 52, 57, and 58, and acquires the detected pressure inside the lower region 16 of the hydraulic jack 10, the first cylinder 21A of the first cylinder mechanism 20A, and the second cylinder 21B of the second cylinder mechanism 20B provided with the pressure sensors 52, 57, and 58.

Further, since the position in the stroke direction of the plunger 22 is correlated with the rotation amount of the output shaft of each of the reduction gear-equipped servomotors 23A and 23B, the control device 90 can acquire the position in the stroke direction of each plunger 22 from the output of the encoder of each of the reduction gear-equipped servomotors 23A and 23B of the first and second cylinder mechanisms 20A and 20B. Further, by obtaining the position in the stroke direction of each plunger 22 from the output of the encoder of each of the reduction gear-equipped servomotors 23A and 23B of the first and second cylinder mechanisms 20A and 20B, the supply/discharge amount of the hydraulic oil by each of the first and second cylinder mechanisms 20A and 20B is substantially obtained.

Control of Operation of Pressurizing Device

Figure 2:
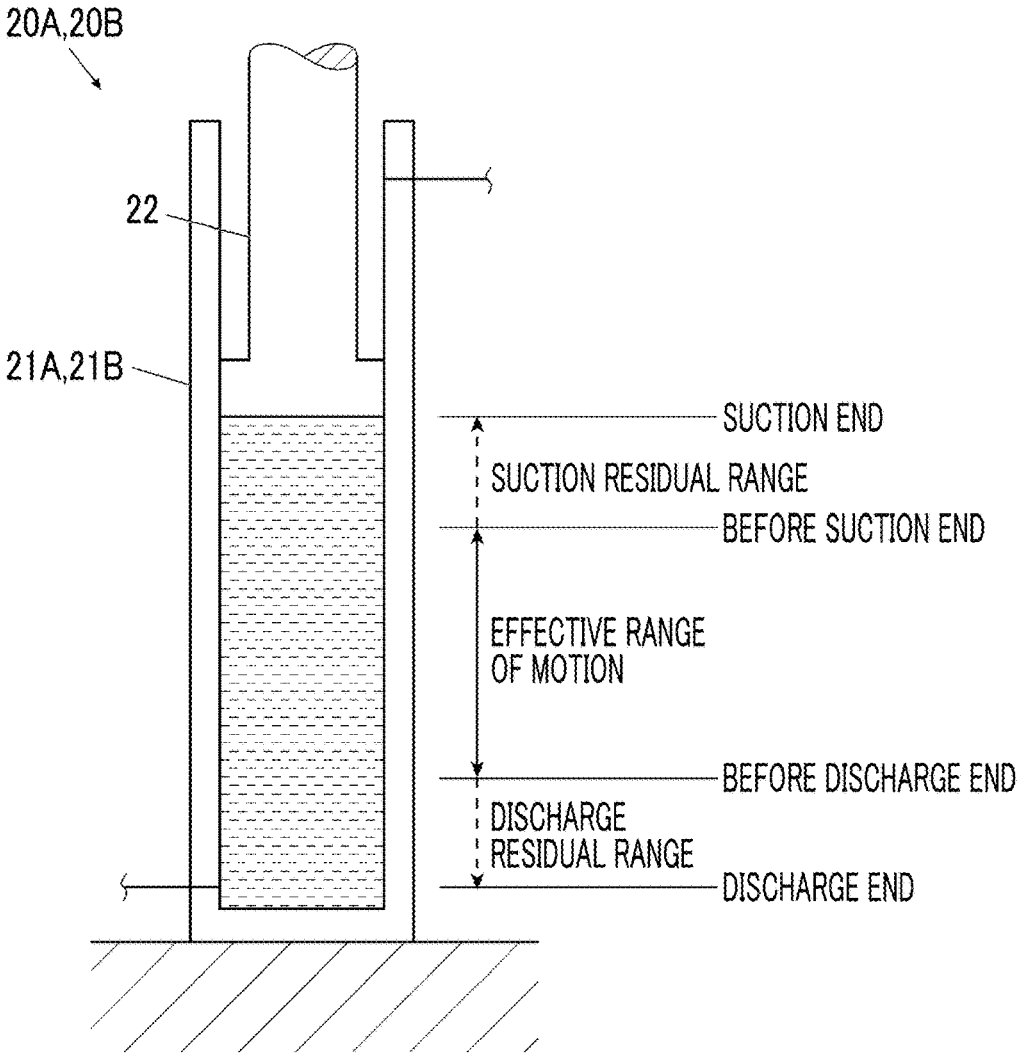
FIG. 2 is an explanatory diagram showing a state of a first cylinder mechanism according to a position in a stroke direction of a plunger of the first or second cylinder mechanism.

FIG. 2 is an explanatory diagram showing the state of the first or second cylinder mechanism 20A or 20B according to the position (the remaining amount of the hydraulic oil inside the first or second cylinders 21A or 21B) in the stroke direction of the plunger 22 of the first or second cylinder mechanism 20A or 20B.

The position of "SUCTION END" of the plunger 22 shown in FIG. 2 is the position of the plunger 22 where the largest amount of hydraulic oil is sucked, and the control device 90 performs a suction operation within a range where the plunger 22 does not exceed the "SUCTION END".

The position of "BEFORE SUCTION END" is in the vicinity of the "SUCTION END", and when the plunger 22 reaches the position of "BEFORE SUCTION END" while the suction of the hydraulic oil is performed, the control device 90 recognizes proximity to the "SUCTION END".

Further, the range from the position of "BEFORE SUCTION END" to the position of the "SUCTION END" is defined as a "SUCTION RESIDUAL RANGE".

The position of "DISCHARGE END" of the plunger 22 shown in FIG. 2 is the position of the plunger 22 where the largest amount of hydraulic oil is discharged, and the control device 90 performs a discharge operation within a range in which the plunger 22 does not exceed the "DISCHARGE END".

The position of "BEFORE DISCHARGE END" is in the vicinity of the "DISCHARGE END", and when the plunger 22 reaches the position of "BEFORE DISCHARGE END" while the discharge of the hydraulic oil is performed, the control device 90 recognizes proximity to the "DISCHARGE END".

Further, the range from the position of "BEFORE DISCHARGE END" to the position of the "DISCHARGE END" is defined as a "DISCHARGE RESIDUAL RANGE".

Further, the range between the position of "BEFORE DISCHARGE END" and the position of "BEFORE SUCTION END" is defined as an "EFFECTIVE RANGE OF MOTION".

The pressurization/depressurization control of the hydraulic jack 10 that is executed by the control device 90 will be described.

The control device 90 is characterized in that in the pressurization/depressurization control of the hydraulic jack 10, it performs transition control to transition from a first supply state where the hydraulic oil is supplied from the first cylinder mechanism 20A to the lower region 16 of the hydraulic jack 10 to a second supply state where the hydraulic oil is supplied from the second cylinder mechanism 20B to the lower region 16 of the hydraulic jack 10, when satisfying a remaining amount condition indicating that the remaining amount of the hydraulic oil in the first cylinder 21A of the first cylinder mechanism 20A is small.

In the first supply state, the hydraulic oil may be supplied only from the first cylinder mechanism 20A. Further, in the second supply state, the hydraulic oil may be supplied only from the second cylinder mechanism 20B.

Figure 3:
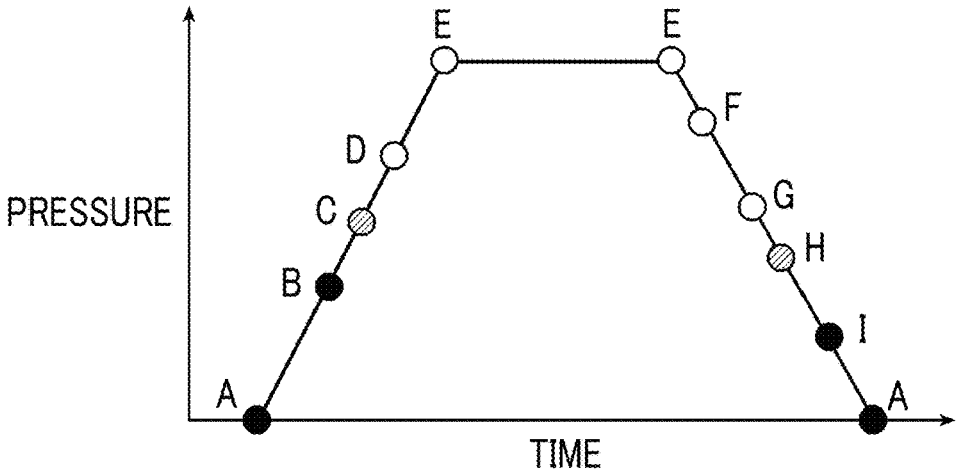
FIG. 3 is an operation diagram showing a change over time in internal pressure of a lower region of a hydraulic jack during an operation from the start of pressurization to the end of depressurization at the time of pressurization/depressurization control of the hydraulic jack.

FIG. 3 is an operation diagram showing a change over time in the internal pressure of the lower region 16 of the hydraulic jack 10 during the operation from the start of pressurization to the end of depressurization at the time of the pressurization/depressurization control of the hydraulic jack 10, and in the drawing, the vertical axis represents pressure and the horizontal axis represents time. Further, FIG. 4 is a diagram showing the control operations of the first and second cylinder mechanisms 20A and 20B by the control device 90 associated with the change in the internal pressure of the lower region 16 shown in FIG. 3, in the pressurization/depressurization control of the hydraulic jack 10.

In FIG. 4, "NO. 1 PUMP" represents the first cylinder mechanism 20A, and "NO. 2 PUMP" represents the second cylinder mechanism 20B.

The control device 90 performs the following operation control while detecting the position of the plunger 22 of each of the cylinder mechanisms 20A and 20B.

When pressurizing the object to be pressurized, the object to be pressurized is set with respect to the fixed pressurizing stand 11 and the movable pressurizing stand 12 of the hydraulic jack 10 in a state where the object to be pressurized is held by a plurality of anvils.

Further, the control device 90 closes (OFF) the tank-side valves 53 and 54 in advance, controls the first supply valve 41 to connect the hydraulic pump 32 and the lower region 16 of the hydraulic jack 10, and brings the movable pressurizing stand 12 close to the fixed pressurizing stand 11 within a range in which the object to be pressurized is not pressurized by the hydraulic pump 32.

Then, the control device 90 controls the first supply valve 41 to switch to the position where both the lower region 16 and the upper region 17 of the cylinder 13 of the hydraulic jack 10 are connected to the hydraulic oil tank 33, and controls the second supply valve 42 to connect the merging end portions of the fifth supply/discharge pipe 47 and the sixth supply/discharge pipe 48 to the hydraulic pump 32 side.

Further, it is assumed that both the first and second cylinder mechanisms 20A and 20B are filled with the hydraulic oil until the position of "BEFORE SUCTION END".

As shown in FIGS. 3 and 4, the control device 90 closes (OFF) the tank-side valves 53 and 54, opens (ON) the jack-side valve 55, and closes (OFF) the jack-side valve 56.

Then, the reduction gear-equipped servomotor 23A of the first cylinder mechanism 20A is driven in a discharge direction to start the supply of the hydraulic oil to the lower region 16 of the hydraulic jack 10 (the first supply state). In this way, the plunger 22 moves down from the "SUCTION END" to the "EFFECTIVE RANGE OF MOTION", and the internal pressure of the lower region 16 of the hydraulic jack 10 reaches pressure [A] which is the start pressure.

Further, when the plunger 22 of the first cylinder mechanism 20A reaches the position of "BEFORE DISCHARGE END", the internal pressure of the lower region 16 of the hydraulic jack 10 reaches pressure [B] (the remaining amount condition of the first cylinder mechanism).

In this way, the control device 90 starts the driving in the discharge direction of the reduction gear-equipped servomotor 23B of the second cylinder mechanism 20B while monitoring the detected pressures of the pressure sensors 57 and 58, and increases pressure such that the pressure inside the second cylinder 21B of the second cylinder mechanism 20B becomes equal to the pressure inside the first cylinder 21A of the first cylinder mechanism 20A (the start of the transition control).

Then, when the plunger 22 of the first cylinder mechanism 20A reaches the "DISCHARGE RESIDUAL RANGE", the internal pressure of the lower region 16 of the hydraulic jack 10 reaches pressure [C].

Further, at this point in time, the plunger 22 of the second cylinder mechanism 20B reaches the "EFFECTIVE RANGE OF MOTION", and pressure is increased until the pressure inside the second cylinder 21B of the second cylinder mechanism 20B becomes equal to the pressure inside the first cylinder 21A of the first cylinder mechanism 20A.

In this way, the control device 90 opens (ON) the jack-side valve 56 of the second cylinder mechanism 20B. At this time, since the pressure inside the second cylinder 21B of the second cylinder mechanism 20B is equal to the pressure inside the first cylinder 21A of the first cylinder mechanism 20A, even if the second cylinder mechanism 20B is connected, the occurrence of a pressure fluctuation with respect to the pressure risen state of the lower region 16 of the hydraulic jack 10 is suppressed.

The control device 90 continues a state of supplying the hydraulic oil from both the first cylinder mechanism 20A and the second cylinder mechanism 20B to the lower region 16 of the hydraulic jack 10 until a predetermined time elapses, according to the timekeeping of a built-in timer.

Then, after the lapse of a predetermined time, the control device 90 closes (OFF) the jack-side valve 55 of the first cylinder mechanism 20A, opens (ON) the tank-side valve 53, drives the hydraulic pump 32 to replenish the first cylinder 21A with the hydraulic oil (completion of the transition control, and replenishment control).

The reduction gear-equipped servomotor 23A of the first cylinder mechanism 20A is controlled so as to rotate in a suction direction, and when the plunger 22 reaches the position of "BEFORE SUCTION END", the reduction gear-equipped servomotor 23A is stopped and the tank-side valve 53 is closed (OFF). Further, the second supply valve 42 is switched to the position where the merging end portions of the fifth supply/discharge pipe 47 and the sixth supply/discharge pipe 48 are connected to the hydraulic oil tank 33 side, and the hydraulic pump 32 is stopped.

On the other hand, a state where the hydraulic oil is supplied to the lower region 16 of the hydraulic jack 10 only by the second cylinder mechanism 20B (the second supply state) is created, and the internal pressure of the lower region 16 of the hydraulic jack 10 reaches pressure [D].

When the internal pressure of the lower region 16 of the hydraulic jack 10 reaches pressure [E], which is a target pressure, in a state where the hydraulic oil is supplied only by the second cylinder mechanism 20B (the second supply state), the reduction gear-equipped servomotor 23B of the second cylinder mechanism 20B is switched to the control to maintain the pressure [E].

The control device 90 continues the control to maintain the pressure [E] until a predetermined time elapses by the timekeeping of the built-in timer.

Then, when the pressure [E] is maintained for a predetermined time, the control device 90 drives the reduction gear-equipped servomotor 23B of the second cylinder mechanism 20B in the suction direction. In this way, the depressurization in the lower region 16 of the hydraulic jack 10 is started, and the internal pressure of the lower region 16 of the hydraulic jack 10 reaches pressure [F].

Further, when the plunger 22 of the second cylinder mechanism 20B reaches the position of "BEFORE SUCTION END", the lower region 16 of the hydraulic jack 10 reaches pressure [G].

The control device 90 starts the driving in the discharge direction of the reduction gear-equipped servomotor 23A of the first cylinder mechanism 20A. In this way, the pressure inside the first cylinder 21A of the first cylinder mechanism 20A is increased toward the pressure inside the second cylinder 21B of the second cylinder mechanism 20B.

Then, when the plunger 22 of the first cylinder mechanism 20A reaches the position of "BEFORE DISCHARGE END", the internal pressure of the lower region 16 of the hydraulic jack 10 reaches pressure [H].

Further, at this point in time, the pressure inside the first cylinder 21A of the first cylinder mechanism 20A is increased until it becomes equal to the pressure inside the second cylinder 21B of the second cylinder mechanism 20B.

In this way, the control device 90 switches the reduction gear-equipped servomotor 23A of the first cylinder mechanism 20A to the suction direction, and opens (ON) the jack-side valve 55 of the first cylinder mechanism 20A. At this time, since the pressure inside the first cylinder 21A of the first cylinder mechanism 20A is equal to the pressure inside the second cylinder 21B of the second cylinder mechanism 20B, the occurrence of a pressure fluctuation with respect to the depressurization state of the lower region 16 of the hydraulic jack 10 up to that point is suppressed.

The control device 90 continues the state of sucking the hydraulic oil from the lower region 16 of the hydraulic jack 10 by both the first cylinder mechanism 20A and the second cylinder mechanism 20B until a predetermined time elapses, by the timekeeping of the built-in timer.

Then, after the lapse of a predetermined time, the control device 90 closes (OFF) the jack-side valve 56 of the second cylinder mechanism 20B, and opens (ON) the tank-side valve 54, and the second supply valve 42 connects the merging endportions of the fifth supply/discharge pipe 47 and the sixth supply/discharge pipe 48 to the hydraulic oil tank 33 side. Then, the reduction gear-equipped servomotor 23B of the second cylinder mechanism 20B is controlled to rotate in the discharge direction. At this time, when the plunger 22 of the second cylinder mechanism 20B reaches the position of "BEFORE DISCHARGE END", the reduction gear-equipped servomotor 23B is stopped and the tank-side valve 54 is closed (OFF).

Meanwhile, the lower region 16 of the hydraulic jack 10 is depressurized to pressure [I].

Then, when the lower region 16 of the hydraulic jack 10 is depressurized to the pressure [A] that is the same as the start pressure, the reduction gear-equipped servomotor 23A of the first cylinder mechanism 20A is stopped, and the pressurization/depressurization control is ended.

Technical Effect of the Present Embodiment

As described above, in the pressurizing device 1, the control device 90 executes the transition control during the pressurization/depressurization control of the hydraulic jack 10.

Therefore, even in a case where the supply pressure of the hydraulic oil that is required for the hydraulic jack 10 is high, since it is possible to supply the hydraulic oil while taking over from the two cylinder mechanisms 20A and 20B, it becomes possible to stably supply the hydraulic oil so as not to cause interruption.

Further, in the pressurizing device 1, the control device 90 makes the jack-side valve 55 be in the connection state and the jack-side valve 56 be in the disconnection state (the pressures [A] and [B] of the lower region 16 of the hydraulic jack 10 in FIGS. 3 and 4), in the first supply state, and when the remaining amount condition is satisfied, after the pressure of the hydraulic oil of the second cylinder mechanism 20B is increased toward the pressure of the hydraulic oil of the first cylinder mechanism 20A, the control device 90 executes the transition control (the pressure [C] of the lower region 16 of the hydraulic jack 10 in FIGS. 3 and 4).

Therefore, when the supply of the hydraulic oil is transitioned from the first cylinder mechanism 20A to the second cylinder mechanism 20B by the transition control, the occurrence of a pressure fluctuation in the lower region 16 of the hydraulic jack 10 is effectively suppressed. Therefore, it becomes possible to more stably supply the hydraulic oil.

Further, the control device 90 performs control to replenish the first cylinder 21A of the first cylinder mechanism 20A with the hydraulic oil with the jack-side valve 55 being in the disconnection state, after the transition control (the pressure [D] of the lower region 16 of the hydraulic jack 10 in FIGS. 3 and 4).

In this way, in the first cylinder mechanism 20A, it becomes possible to quickly perform pressure adjustment by the supply of the hydraulic oil or the discharge of the hydraulic oil without causing interruption due to the replenishment work of the hydraulic oil, when necessary, and it becomes possible to smoothly perform the pressurization/depressurization control of the hydraulic jack 10 and suppress a pressure fluctuation to more stably supply the hydraulic oil or the pressure adjustment.

Further, the control device 90 substantially obtains the supply/discharge amount of the hydraulic oil from the first cylinder mechanism 20A from the position of the plunger 22 that is obtained from the encoder of the reduction gear-equipped servomotor 23A.

Then, when the position of "BEFORE DISCHARGE END" of the plunger 22 indicating a state where the discharge amount has reached a specified amount is detected, it is determined that the remaining amount condition is satisfied.

Therefore, the start timing of the transition control can be appropriately determined, and it becomes possible to more stably supply the hydraulic oil.

Others

Although the embodiment of the present invention has been described above, the present invention is not limited to the above embodiment.

For example, the pressurizing device 1 may have a configuration in which one or both of the first cylinder mechanism 20A and the second cylinder mechanism 20B are provided in plurality.

In that case, in a case where there are a plurality of first cylinder mechanisms 20A, the fifth supply/discharge pipe 47 and the seventh supply/discharge pipe 49 and other configurations provided at the supply/discharge pipes 47 and 49 may be provided individually for each of the first cylinder mechanisms 20A. The same applies to the second cylinder mechanism 20B.

Alternatively, in a case where there are a plurality of first cylinder mechanisms 20A, the first cylinder mechanisms 20A may be connected in parallel to one fifth supply/discharge pipe 47 and one seventh supply/discharge pipe 49. The same applies to the second cylinder mechanism 20B.

In this manner, in a case where one or both of the first cylinder mechanism 20A and the second cylinder mechanism 20B are provided in plurality, a larger supply/discharge amount of the hydraulic oil with respect to the lower region 16 of the hydraulic jack 10 can be secured, and even in a case where the supply pressure of the hydraulic oil that is required for the hydraulic jack 10 is high, it becomes possible to more stably supply the hydraulic oil.

Further, the pressurizing device 1 may be configured to include one or a plurality of other cylinder mechanisms other than the first cylinder mechanism 20A and the second cylinder mechanism 20B. The other cylinder mechanism preferably has the same configuration as the first cylinder mechanism 20A and the second cylinder mechanism 20B.

In that case, it is preferable that the other cylinder mechanism is provided with two supply/discharge pipes that are the same as the fifth supply/discharge pipe 47 and the seventh supply/discharge pipe 49, and the same configuration as each configuration provided in the supply/discharge pipes 47 and 49 is provided in each of the two supply/discharge pipes that are the same as the fifth supply/discharge pipe 47 and the seventh supply/discharge pipe 49, and the two supply/discharge pipes are connected in parallel in the same manner as the fifth supply/discharge pipe 47 and the seventh supply/discharge pipe 49 being disposed in parallel with the sixth supply/discharge pipe 48 and the eighth supply/discharge pipe 50.

Further, in that case, it is preferable that the control device 90 performs transition control (the same control as the transition control described above) to transition to the supply state where the hydraulic oil is supplied from the other cylinder mechanism to the lower region 16 of the hydraulic jack 10 when the remaining amount condition of the hydraulic oil in the second cylinder 21B of the second cylinder mechanism 20B (for example, the remaining amount condition is set to be the same condition as that in the first cylinder mechanism 20A) is satisfied, in the second supply state.

Further, in a case where a plurality of other cylinder mechanisms are provided, when the remaining amount condition (for example, it is set to be the same condition as that in the first cylinder mechanism 20A) is satisfied with respect to one of the other cylinder mechanisms, it is preferable to perform transition control (the same control as the transition control described above) to transition to the supply state where the hydraulic oil is supplied from the other cylinder mechanism to the lower region 16 of the hydraulic jack 10.

In this manner, in the case of the configuration in which one or a plurality of other cylinder mechanisms other than the first cylinder mechanism 20A and the second cylinder mechanism 20B are provided, it is possible to secure a larger supply/discharge amount of the hydraulic oil with respect to the lower region 16 of the hydraulic jack 10, and even in a case where the supply pressure of the hydraulic oil that is required for the hydraulic jack 10 is high, it becomes possible to more stably supply the hydraulic oil.

Further, each of the cylinder mechanisms 20A and 20B or the hydraulic jack 10 may adopt a liquid pressure mechanism using liquid pressure (for example, water pressure) by a liquid other than the hydraulic oil.

In addition, the details shown in the above embodiment can be appropriately changed within a scope which does not depart from the gist of the invention.

It should be understood that the invention is not limited to the above-described embodiment, but may be modified into various forms on the basis of the spirit of the invention. Additionally, the modifications are included in the scope of the invention.

What is claimed is:

1. A pressurizing device comprising:

a pressurizing unit that pressurizes an object to be pressurized by supply of a working fluid;

a first cylinder mechanism that includes a first drive source and a first cylinder and supplies the working fluid in the first cylinder to the pressurizing unit by output of the first drive source;

a second cylinder mechanism that includes a second drive source and a second cylinder and supplies the working fluid in the second cylinder to the pressurizing unit by output of the second drive source; and a control device that controls the first drive source of the first cylinder mechanism and the second drive source of the second cylinder mechanism, wherein the control device is configured to perform transition control to transition to a second supply state where the working fluid is supplied from the second cylinder mechanism to the pressurizing unit when a remaining amount condition of the working fluid in the first cylinder of the first cylinder mechanism is satisfied in a first supply state where the working fluid is supplied from the first cylinder mechanism to the pressurizing unit.

2. The pressurizing device according to claim 1, further comprising:

a first switching unit configured to switch between a connection state and a disconnection state of a flow of the working fluid between the first cylinder mechanism and the pressurizing unit;

a second switching unit configured to switch between a connection state and a disconnection state of a flow of the working fluid between the second cylinder mechanism and the pressurizing unit;

a first pressure measuring unit that measures pressure of the working fluid of the first cylinder mechanism; and a second pressure measuring unit that measures pressure of the working fluid of the second cylinder mechanism, wherein the control device makes the first switching unit be in the connection state and the second switching unit be in the disconnection state, in the first supply state, and increases the pressure of the working fluid of the second cylinder mechanism toward the pressure of the working fluid of the first cylinder mechanism and then performs the transition control, when the remaining amount condition is satisfied.

3. The pressurizing device according to claim 2, wherein the control device performs control to replenish the first cylinder of the first cylinder mechanism with the working fluid with the first switching unit being in the disconnection state, after the transition control.

4. The pressurizing device according to claim 1, wherein the control device obtains a discharge amount of the working fluid from the first cylinder mechanism, and determines that the remaining amount condition is satisfied, in a state where the discharge amount reaches a specified amount.

5. The pressurizing device according to claim 1, wherein one or both of the first cylinder mechanism and the second cylinder mechanism are provided in plurality.

6. The pressurizing device according to claim 1, further comprising:

another cylinder mechanism other than the first cylinder mechanism and the second cylinder mechanism, wherein the control device performs control to transition to a supply state where the working fluid is supplied from the other cylinder mechanism to the pressurizing unit, when the remaining amount condition of the working fluid in the second cylinder of the second cylinder mechanism is satisfied, in the second supply state.

7. The pressurizing device according to claim 1, wherein the first cylinder mechanism includes a first plunger slidable inside the first cylinder, and a first linear motion mechanism that imparts an advance/retreat movement operation to the first plunger, and the second cylinder mechanism includes a second plunger slidable inside the second cylinder, and a second linear motion mechanism that imparts an advance/retreat movement operation to the second plunger.

8. The pressurizing device according to claim 7, wherein the first drive source is a first reduction gear-equipped servomotor, the first linear motion mechanism is a first ball screw mechanism that includes a first ball screw which is rotationally driven by the first reduction gear-equipped servomotor, and a first movable frame that includes a first ball nut screwed to the first ball screw, the second drive source is a second reduction gear-equipped servomotor, and the second linear motion mechanism is a second ball screw mechanism that includes a second ball screw which is rotationally driven by the second reduction gear-equipped servomotor, and a second movable frame that includes a second ball nut screwed to the second ball screw.

9. The pressurizing device according to claim 8, wherein the first ball screw is provided parallel to a stroke direction of the first plunger, the first movable frame is fixedly connected to an outer end portion of the first plunger, the second ball screw is provided parallel to a stroke direction of the second plunger, and the second movable frame is fixedly connected to an outer end portion of the second plunger.

10. The pressurizing device according to claim 9, wherein the first reduction gear-equipped servomotor includes a first encoder that inputs a rotation amount of the first reduction gear-equipped servomotor to the control device, and the second reduction gear-equipped servomotor includes a second encoder that inputs a rotation amount of the second reduction gear-equipped servomotor to the control device.

11. The pressurizing device according to claim 7, wherein the first linear motion mechanism or the second linear motion mechanism is a linear motor.

* * * * *